US006003591A

United States Patent [19]

Campbell

[11] Patent Number: 6,003,591

[45] **Date of Patent: *Dec. 21, 1999**

[54] FORMED LAMINATE HEAT PIPE

[75] Inventor: Geoffrey O. Campbell, Long Beach, Calif.

[73] Assignee: Saddleback Aerospace, Los Alamitos, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/996,081

[22] Filed: Dec. 22, 1997

[51] Int. Cl.[6] ..... F28D 15/00

[52] U.S. Cl. ..... 165/104.26; 165/185

[58] Field of Search ..... 165/104.26, 185, 165/80.3, 104.33; 361/700; 257/715

[56] References Cited

U.S. PATENT DOCUMENTS

| | | | |
|---|---|---|---|
| 3,490,718 | 1/1970 | Vary . | |
| 3,532,158 | 10/1970 | Hiebert . | |
| 3,613,778 | 10/1971 | Feldman, Jr. . | |
| 3,749,156 | 7/1973 | Fletcher et al. . | |
| 3,971,435 | 7/1976 | Peck . | |
| 4,019,098 | 4/1977 | McCready et al. . | |
| 4,042,757 | 8/1977 | Jones . | |
| 4,109,709 | 8/1978 | Honda et al. . | |
| 4,463,798 | 8/1984 | Pogson et al. . | |
| 4,789,026 | 12/1988 | Shank et al. . | |
| 4,830,097 | 5/1989 | Tanzer . | |
| 4,846,263 | 7/1989 | Miyazaki et al. . | |
| 4,880,053 | 11/1989 | Sheyman | 165/104.26 |
| 4,934,160 | 6/1990 | Mueller . | |
| 5,010,951 | 4/1991 | Kapolnek et al. . | |
| 5,179,043 | 1/1993 | Weichold et al. . | |
| 5,666,261 | 9/1997 | Aguilera | 165/185 X |

FOREIGN PATENT DOCUMENTS

| | | | |
|---|---|---|---|
| 2235792 | 1/1974 | Germany | 165/104.26 |
| 0083587 | 4/1988 | Japan | 165/104.26 |
| 0559099 | 5/1977 | U.S.S.R. | 165/104.26 |
| 0987357 | 1/1983 | U.S.S.R. | 165/104.26 |
| 1101662 | 7/1984 | U.S.S.R. | 165/104.26 |
| 1402509 | 8/1975 | United Kingdom | 165/104.26 |

*Primary Examiner*—Christopher Atkinson
*Attorney, Agent, or Firm*—Fulwider Patton Lee Utecht, LLP

[57] ABSTRACT

A heat pipe device having precisely dimensioned vapor passages and liquid passages is formed by laminating a multitude of layers of foil. Each foil layer has a pattern of perforations and half-etchings formed therein. Lamination of said foil layers provides a highly efficient heat transfer device capable of carrying structural loads.

17 Claims, 5 Drawing Sheets

FORMED LAMINATE HEAT PIPE

BACKGROUND OF THE INVENTION

The present invention generally relates to heat pipe devices and more particularly pertains to the improvement of such devices. Specifically, the improvements encompass enhanced heat transfer efficiency as well as increased mechanical strength, conformability to a wide variety of geometric configurations, a reduction of specific weight and volume and manufacturability at relatively low cost.

Heat pipes provide a heat transfer function with a structure that is wholly devoid of moving parts. Such devices generally include a combination of relatively large conduits and small capillary-like structures that extend between two surfaces, one such surface being adjacent a heat source and the other being adjacent a heat sink. A quantity of coolant is contained within the device wherein the coolant is selected so as to evaporate upon contact with the hot surface and condense upon contact with the cold surface. The conduits enable the transport of vaporized coolant toward the heat sink where it reassumes its liquid state while the capillary structure facilitates the return of the liquid coolant to the heat source by capillary action. The coolant is thereby available for the continuous repetition of the cycle.

Various structural configurations have been found to be effective as heat pipe devices including a fabricated honeycomb structure that is capped by faceplates and lined with mesh material. The interior space of each honeycomb cell functions as a vapor conduit while the mesh performs the function of a capillary-like structure to wick liquid coolant from the cold to the hot faceplate. Efforts to enhance the heat transfer capacity of such devices have typically entailed the substitution of various composite materials for the aluminum normally used in the construction thereof. Additionally, because such devices are often intended for applications with strict space and weight limitations, it is most desirable to minimize both their weight and volume. It is especially preferable to have the ability to wholly integrate a heat pipe device within structural components that are necessarily associated with a particular application. For example, a heat pipe structure integrated within the walls, struts, and/or shelves of a satellite could fulfill the heat transport/rejection requirements without taking up space or adding weight to the spacecraft. The feasibility of a particular heat pipe design for such applications not only depends upon its specific heat transfer capacity, both in terms of weight and volume, but also its configurability to a wide range of geometries and orientations. These capabilities must be available without compromise to the structural strength while the device must nonetheless be economical to manufacture. The previously known devices have been unable to adequately fulfill all these requirements simultaneously especially as necessitated in microsatellite applications.

SUMMARY OF THE INVENTION

The present invention provides a heat pipe device that is inherently strong and is extremely efficient in transferring heat from a hot to a cold surface. Moreover, the device is easily configured in a wide variety of geometries and orientations and is therefore readily integrated within structural components. Utilization thereof minimizes and can possibly eliminate parasitic weight and volume in some applications. The device is relatively economical to produce due in part to the minimal amount of tooling utilized in its manufacture.

More particularly, the heat pipe device of the present invention consists of a lamination of individually etched and perforated foil layers wherein perforations and etchings formed therein cooperate to define cells, ducts, capillary-like structures and arteries that extend throughout the device. Moreover, because the position, size, and shape of each perforation and etching can be varied from layer to layer, the resulting conduits, as well as the outer envelope of the entire device, can be manufactured so as to conform to virtually any desired geometry. Such capability provides for extreme flexibility in terms of accessing one or more heat sources, accessing one or more heat sinks and the routing of a cooling path or paths therebetween. Additionally, the heat pipe device may readily be shaped to precisely conform to the heat source and the heat sink so as to maximize the transfer of heat therebetween. Furthermore, the etchings and perforations are easily configured so as to transport heat in either one, two or three dimensions. Both the liquid as well as the gaseous phases of the coolant contained therein are free to translate throughout the available flow paths and as a result, heat is automatically transferred from wherever a region of high temperature is located to wherever a region of low temperature is located.

In a preferred embodiment, metallic foil is appropriately processed so as to have formed therein a pattern of precisely dimensioned perforations and half-etchings. A plurality of such foil layers, each with a selected pattern of perforations and half-etchings, are subsequently stacked, one on top of another, wherein the various perforations and half-etchings in the layers cooperate to define the various vapor and liquid conduits. The larger conduits facilitate the transport of vapor while extremely small passages or grooves support capillary action for the transport of liquid. More specifically, vapor transport in a single dimension is typically achieved by a plurality of parallel cells wherein such cells may optionally be set into fluid communication with one another via ducts to provide for multi-dimensional vapor transport. Grooves formed on the walls of the cells and extending along their lengths serve for the one dimensional transport of liquid while gaps may be formed between adjoining cells to define arteries that not only provide additional parallel flowpaths but provide for the multi-dimensional transport of liquid. Alternatively, pores formed in the cell walls serve as a wick by forming a capillary interface between the interior of the cell and the adjoining arterial network. Faceplates cap the cells and serve to seal the structure, while grooves formed on the interior surface of the faceplates further set the capillaries and the arterial network into fluid communication with the vapor conduits. The device is positioned such that one faceplate or portion thereof is adjacent the heat source and another faceplate or portion thereof is adjacent a heat sink. In this particular configuration, the sections of cell wall adjacent the faceplates provide extended firm structures to augment face sheet heat transfer areas.

Construction of a heat pipe device of the present invention is generally accomplished as follows. Upon considering the heat transfer requirements and available space in a particular application, the exterior envelope of the device determined. Subsequent thereto, the internal routing of the cells, ducts, capillaries and arterial network is designed so as to optimize the utilization of the available interior space and provide for either a single or multi-dimensional heat transfer configuration. The corresponding pattern of perforations and half etchings are then determined for each individual layer of foil. Such pattern is imparted to the individual foils wherein the precise dimensioning and shaping of the capillaries that is thereby possible allows capillary action performance to be optimized. The flexibility of such system is inherent in the fact that the manufacturing process is substantially unaffected by the complexity of the configurational requirements that may be dictated by a particular application. The effort required to manufacture a particular foil is substantially the same regardless of the number of heat sources, their positions and configurations, the number of heat sinks, their positions and configurations and the paths available therebetween. The individual layers are ultimately stacked and bonded to one another to form a substantially monolithic structure. When integrated within a structural component, the heat pipe device of the present invention serves to carry the structural loads while automatically and highly efficiently transferring heat from hot regions to the relatively colder regions.

These and other features and advantages of the present invention will become apparent from the following detailed description of a preferred embodiment which, taken in conjunction with the accompanying drawings, illustrates by way of example the principles of the invention.

DETAILED DESCRIPTION OF THE PREFERRED EMBODIMENTS

Figure 1:
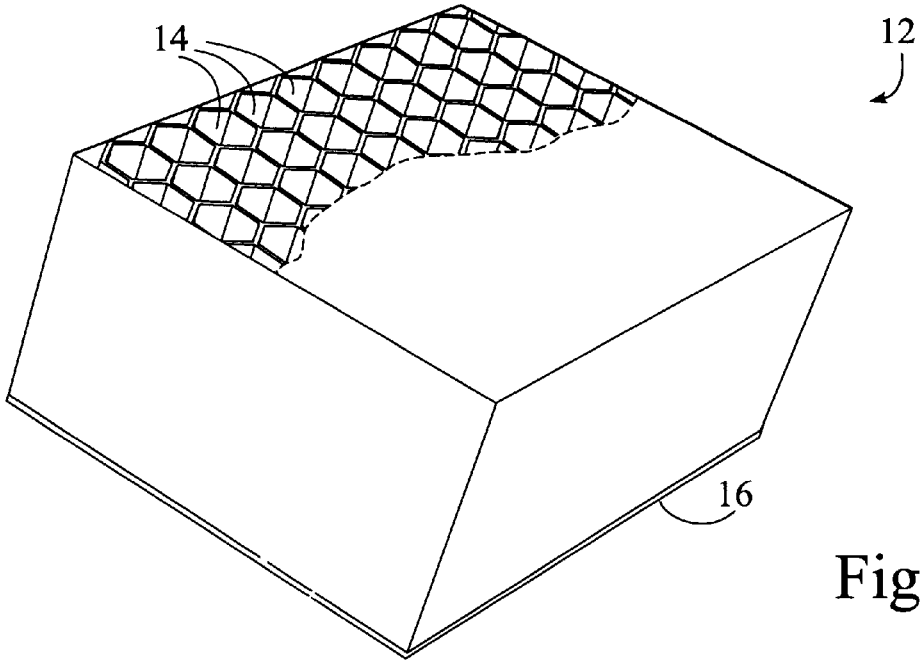
FIG. 1 is a perspective view of a heat pipe device of the present invention without its top faceplate.

FIG. 1 generally illustrates a heat pipe device of the present invention. The substantially cubic outer envelope comprises an arbitrary configuration and is shown for illustration purposes only. As will become apparent, the outer envelope of the device of the present invention is easily configured to accommodate any of a wide variety of geometries and orientations. The device can therefore be readily incorporated within any number of structural components and serve as a load bearing member while performing the function of transferring heat from a heat source to a heat sink.

As is shown in FIG. 1, a preferred embodiment heat pipe device 12 of the present invention consists of an array of individual cells 14 that extend through the interior of the device. In the particular embodiment shown, the cells are hexagonal in cross-section and are arranged in a honeycomb pattern. Such geometry is again substantially arbitrary and is selected for illustrative purposes only. As will become apparent, the internal structure of the device of the present invention can assume a wide variety of configurations. A faceplate 16 seals the bottom of the device, while a similar faceplate would be employed to seal the top of the device. The top faceplate has been removed from the device illustrated in FIG. 1 to reveal the cell structure therein.

Figure 2:
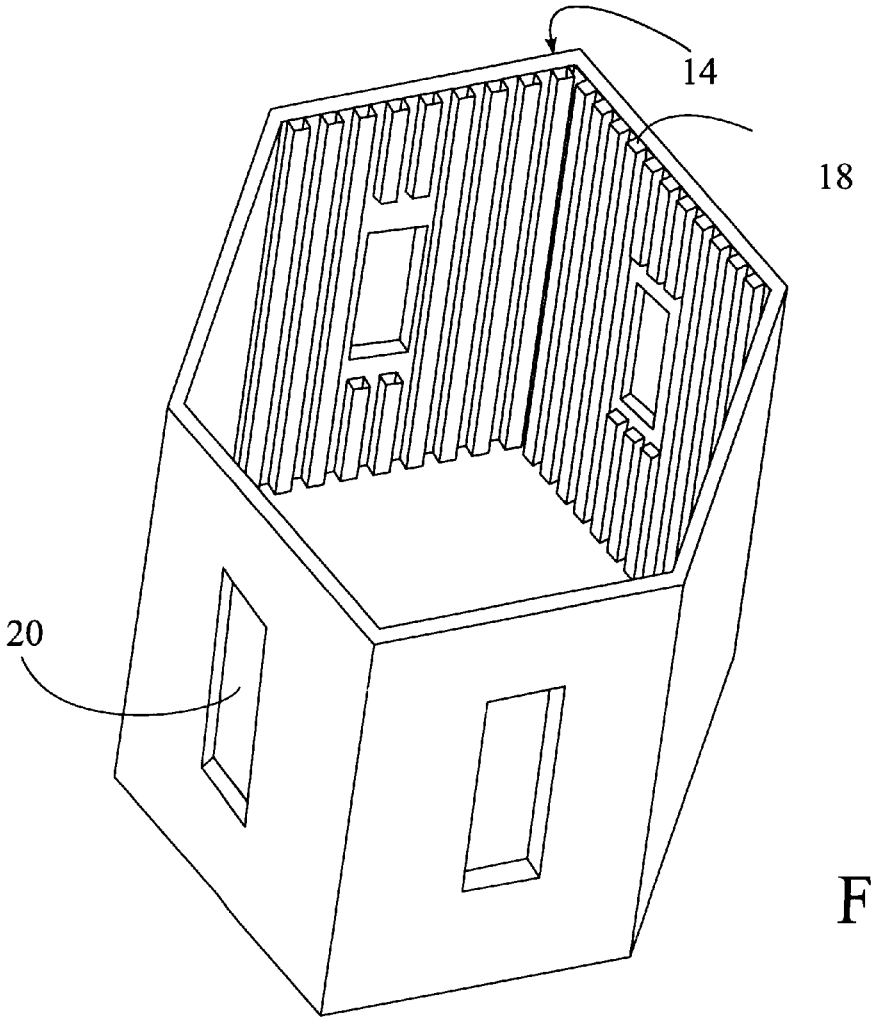
FIG. 2 is a greatly enlarged perspective view of a single cell.

FIG. 2 is a greatly enlarged view of a single cell 14 as may be employed in the device shown in FIG. 1 and shows detail as to its structure. While the interior of the cell defines a vapor conduit, grooves 18 formed along its interior walls serve as capillaries to facilitate the transport of liquid in the cross-laminate direction. The cell dimensions are predominantly dictated by the structural strength requirements for the device, while the groove dimensions determine the efficiency of the capillary action that is achieved, wherein generally the smaller and narrower groove, the greater the pressure differential that is generated thereby. The embodiment shown additionally illustrates the optionally incorporated ducts 20 which set adjacent cells into fluid communication with one another and thereby facilitate the multi-dimensional transfer of vapor. Incorporation of said ducts requires the addition of an intercellular capillary network as well, such as is discussed below.

Figure 3:
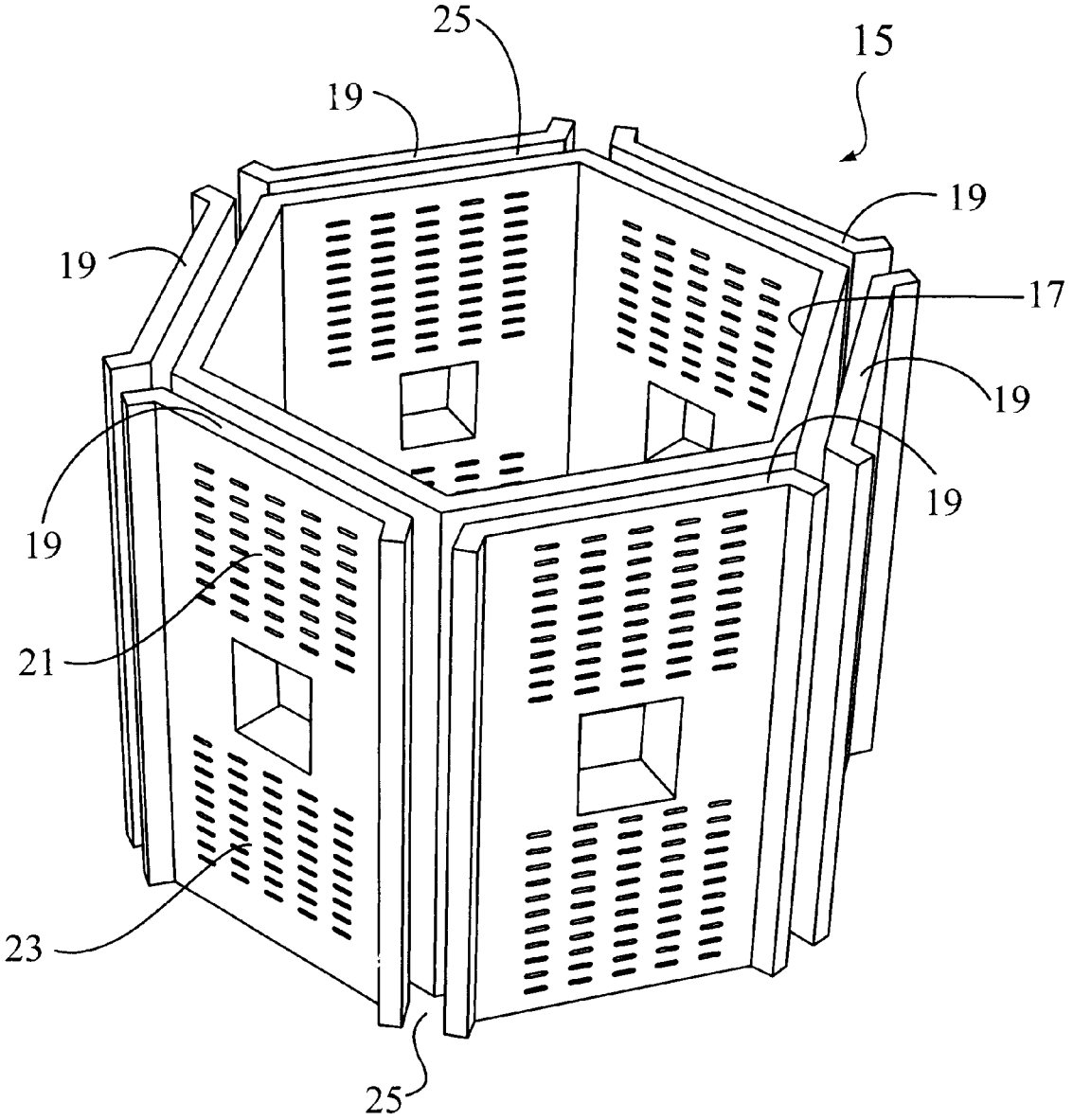
FIG. 3 is a greatly enlarged perspective view of alternative embodiment of a single cell.

FIG. 3 is a greatly enlarged view of an alternative embodiment cell structure 15 and more particularly shows one complete cell 17 along with portions of the six adjoining cells 19. Rather than relying on a parallel groove structure formed on the interior walls of each cell to achieve capillary action as shown in FIG. 2, the embodiment illustrated in FIG. 3 employs arrays of capillary pores 21, 23 that set the interior of each cell into fluid communication with the gap 25 formed between adjacent cells. The pores are located in what amounts to the evaporator and condenser sections which are separated by an adiabatic region. The array of pores acts as a mesh wick and draws liquid into the arterial network defined by the inter-cellular gaps wherein the liquid contained in such arterial network is then free to translate in all three dimensions. Ducts 27 located in the adiabatic region facilitate the multi-dimensional transport of vapor between the cells and in order to prevent entrainment concerns in that region, the ducts are sealed off from the liquid flow.

Figure 4:
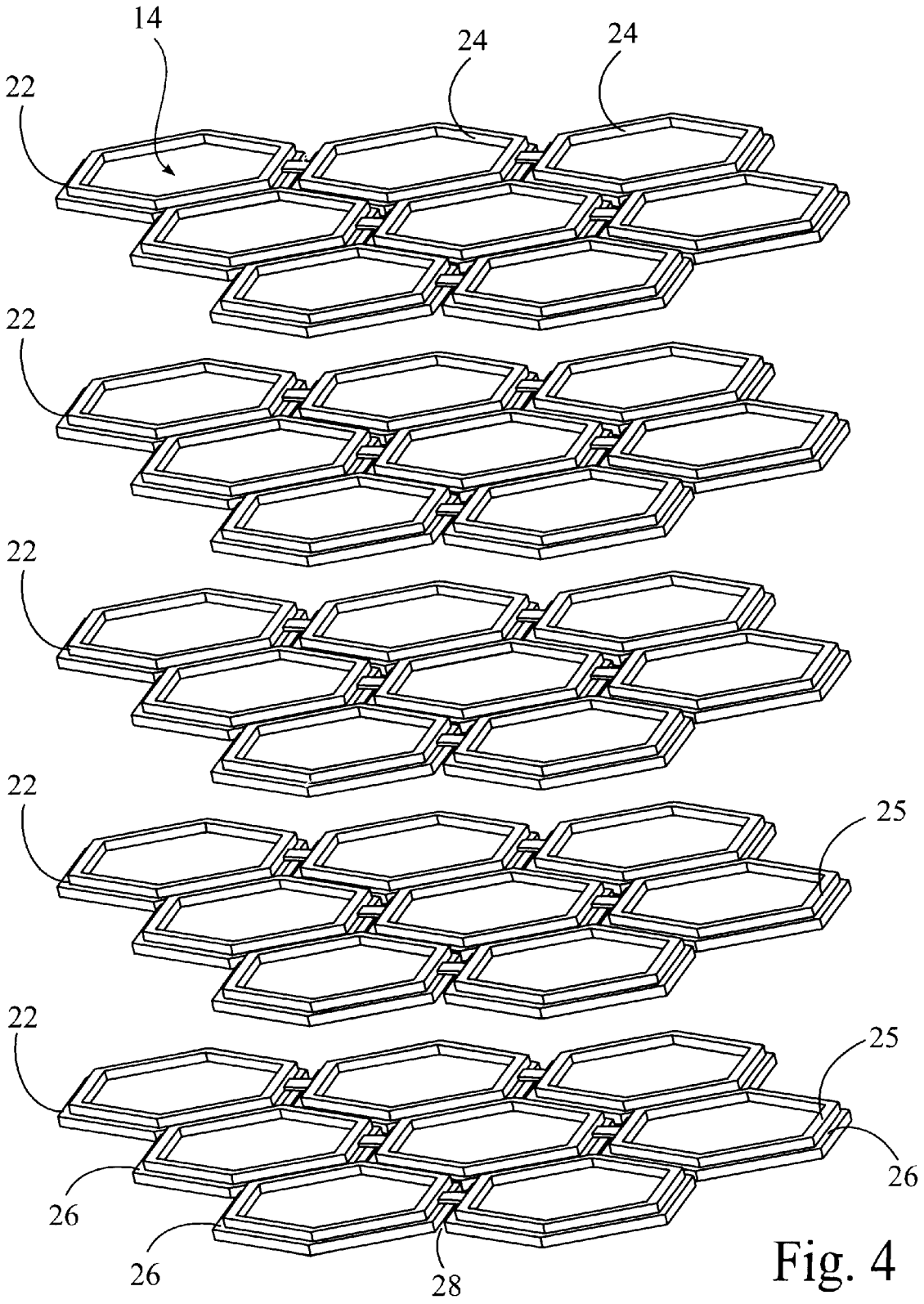
FIG. 4 is a greatly enlarged exploded view of a plurality of laminations used in the construction of a heat pipe device of the present invention.

FIG. 4 is a greatly enlarged and exploded view of a small portion of an alternative embodiment heat pipe device showing a section of five layers that define nine adjacent cells. As is apparent from this view, the heat pipe device consists of an assembly of numerous laminae 22 that are stacked on top of one another. In this particular example, each laminae has an array of hexagonal perforations 24 formed therein that are approximately 5 mm across, which in combination with the other layers, form the hexagonal cells such as are visible in FIG. 1. In this embodiment, all intercellular transport of liquid is achieved in the space between cells while the interior of the cells is exclusively utilized for the transport of vapor. Each hexagonal perforation is surrounded by ridge 25 which in turn is further surrounded by a recess 26 formed in the top surface of the foil. Upon assembly with other foil layers, the gap between the bottom of the recess and the bottom surface of the foil layer positioned thereover defines a capillary-like structure as little as 25 $\mu$m wide and as little as 25 $\mu$m deep. The combined effect of the recesses surrounding each of the cells is to provide a capillary network that extends along the plane of each laminae. Moreover, each cell and its surrounding recess is spaced from the adjoining cell and corresponding recess so as to form a gap 28 of arbitrary width which upon assembly sets the planar network of capillaries on each laminae into fluid communication with the vapor traveling through the intercellular region. Not shown in the figure are the requisite vapor ports from the cell interiors to the intercellular region, nor cross-laminate capillaries such as are shown in FIG. 2 to return the liquid to the faceplates. The cell structure of the device is sandwiched between faceplates 16 that serve to seal the interior of the device. The interior surface of each faceplate has a pattern of grooves formed thereon that set the interior of the cells into fluid communication with the capillary gap extending about each of the cell's exteriors.

An additional component crucial to the function of the heat pipe device is the quantity of coolant that is contained within the interior of the device. The coolant is selected so as to evaporate upon being subjected to the temperature that the heat source is expected to generate and condense upon being subjected to the temperature associated with the heat sink. The liquid must additionally be compatible with the material used 11 the construction of the device. An example of a suitable coolant/heat pipe combination that may be used is water/copper. The quantity of coolant employed depends upon the volume of the capillary wick and arterial passages. A typical charge of coolant in its liquid phase would displace approximately 10% of the total interior volume of the device.

Figure 5:
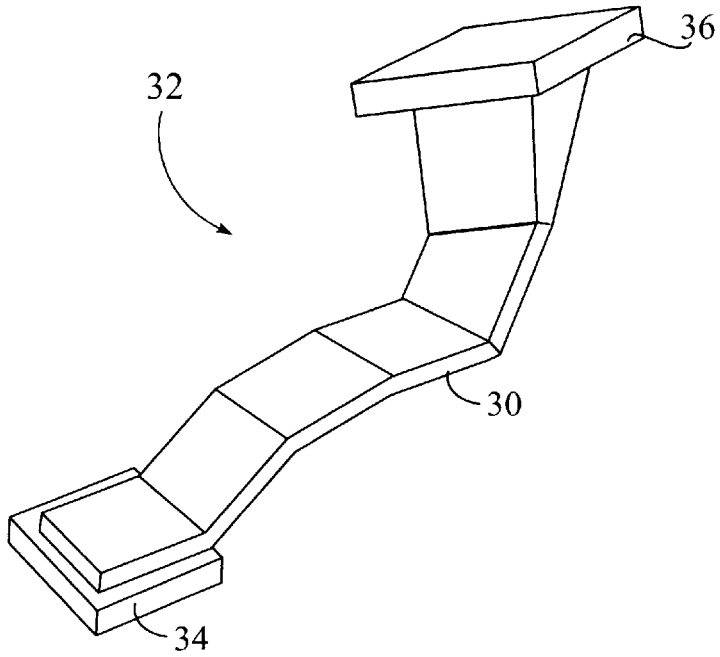
FIG. 5 is a perspective view illustrating a heat pipe device of the present invention interconnecting a heat source and a heat sink along a convoluted flowpath.
Figure 6:
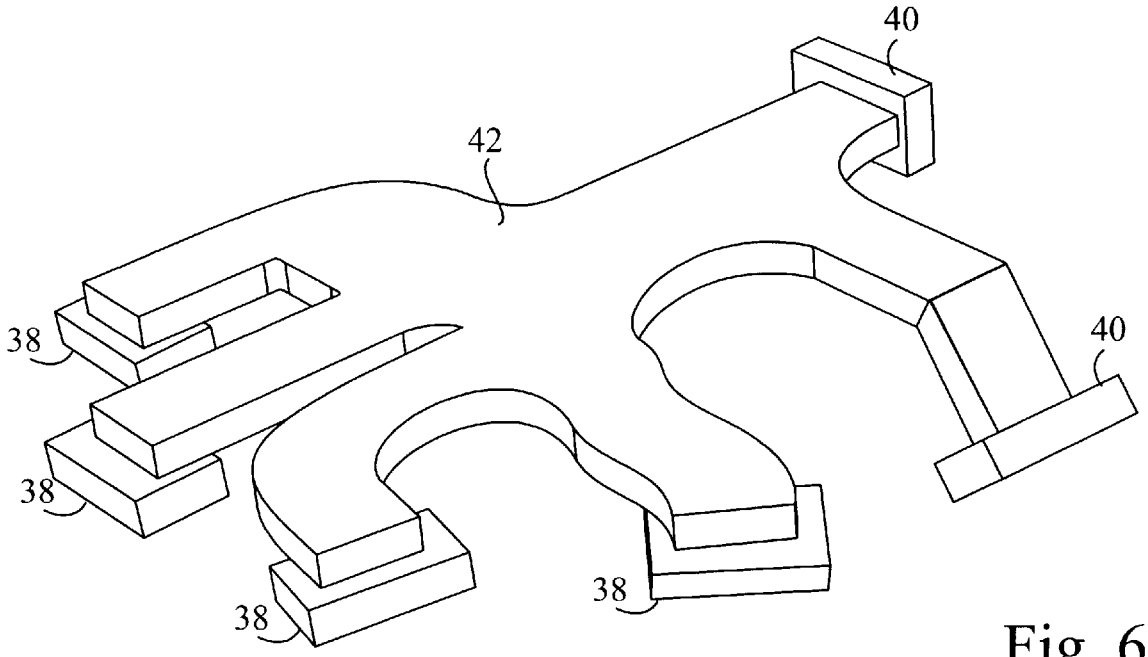
FIG. 6 is a perspective view illustrating a heat pipe device of the present invention interconnecting multiple heat sources to multiple heat sinks.

The overall configuration of the heat pipe device may conform to virtually any geometric configuration. For example, in the heat pipe 30 depicted in FIG. 5, the flowpath 32 between heat source 34 and heat sink 36 is rather convoluted. The flowpath in the device of the present invention is in no way constrained to a single dimension or a straight line. FIG. 6 illustrates a configuration wherein multiple heat sources 38 are linked to multiple heat sinks 40 by a single heat pipe device 42. The out-of-plane branches require the assembly of multiple in-plane components.

The construction of a heat pipe device of the present invention is accomplished as follows. The overall layout of the device is initially established with regard to the location of the heat source or sources, the location of the heat sink or sinks and the available space therebetween. In addition to considering the maximum outer envelope of the heat pipe device, it is necessary to take into consideration the structural loads the device is to be subjected to. Additionally, the faceplate surfaces must be oriented relative to the heat source and heat sink and conformed thereto so as to optimize heat transfer from the heat source to the heat pipe device as well as from the heat pipe device to the heat sink. The pattern of perforations and etchings in each individual foil must then be established such that optimal continuity is achieved amongst the various cell, port, capillary and arterial structures in order to facilitate the desired vapor and liquid transport properties. Finally, consideration must be given to whether such layouts can effectively be formed from individual foils.

The architecture of a heat pipe device of the present invention is largely dictated by the specific application. A particular embodiment that was found to deliver satisfactory results includes the following dimensions and appears substantially as illustrated in FIG. 3. The overall height of the device, i.e. the length of each hexagonal cell is 0.25" while the maximum diameter of each cell is 0.26". Furthermore, the wall thickness is 0.015" while the gap between adjacent cells is 0.015". The ducts measure 0.132"×0.66" and in an effort to maintain foil integrity, each duct actually comprises a grid of half-etched bars to reduce the actual vapor port flow area to 0.066"×0.06". The capillary pores measure 0.002"×0.006" and each pore grid covers about an area of 0.07"×0.056". The arteries are set into fluid communication with the cells by a hexagonal grid of 0.006"×0.004" grooves in the faceplates.

A standard photochemical etching processes was employed to fabricate the heat pipe device described above. Master art was designed and the design was converted to the Gerber language. The Gerber files were transmitted to a vendor, where the master films were prepared using a laser photo plotter. The films were printed as actual size negatives, since the use of negative photoresist for etching is less susceptible to dirt and dust than a positive process.

Glidcop® AL-15 low-oxygen foil was procured from J. L. Anthony, Inc. (Providence, R.I.). Glidcop® is a dispersion-strengthened copper alloy which has nearly 90% the conductivity of copper, and superior strength and diffusion bonding properties. The low-oxygen content is desirable in the diffusion bonding process.

Before etching, each sheet was cleaned and coated with photoresist. The cleaning process consisted of mechanical scrubbing using an Alconox cleanser and a mild abrasive pad. Shipley 2029 photoresist was applied by dip-coating each foil at a rate of 1 inch/minute. The resist-coated sheet was placed between the two requisite pieces of artwork, and exposed to high-intensity near-UV light. Exposed resist was removed with a developer, and the remaining resist was hardened in a mild bake cycle.

After baking, the sheets were placed in a rotary vertical spray chemical etcher. The etchant, FeCl, was kept at 105° F. throughout the etching runs. Typically a 0.004" foil would take approximately 1 minute to etch halfway through. In those areas where precisely the same point on either side of the foil is exposed to etchant, full perforation would result in such period of time. The etched sheet was then rinsed and a chemical stripper was used to remove the resist. The sheets were sent to a vendor, where they were plated with a thin flash copper coat. The copper plating has been found to promote diffusion bonding for many materials.

The plated sheets were inspected, and the individual foils were separated from the sheets. The foils were dip-cleaned in a mild HCl solution as necessary, and then stacked on a molybdenum bonding fixture. The nominal stacking order was: a 0.02" evaporator facesheet foil, 11 0.004" evaporator foils, a 0.004" evaporator cap foil, 33 0.04" vapor port foils, 9 0.004" condenser foils, and a 0.02" condenser facesheet foil. The nominal total stack height was 0.264".

The preferred bonding method is the use of a diffusion bonding process wherein the stack of foils are subjected to a substantial compressive force and temperature which causes the metal grains to exhibit substantial grain growth across the foil boundaries. The resulting bond strength has been shown to approach the strength of the parent material. After the foils are stacked in the appropriate order, the foil stack was clamped between two 0.5" thick molybdenum plates using fourteen ¼" molybdenum bolts. Two 0.5" Glidcop® spacer plates were placed between the plates and the part (one on each side) to provide increased differential expansion between the Glidcop® and the molybdenum bolts. The bolts were torqued to 50 ft-lbs, and the entire assembly was inserted into a furnace. The stack was bonded at 1750° F. (950° C.) for sixty minutes, and then removed from the furnace after it had cooled. After bonding, two 0.188" OD copper tubes were brazed thereto to serve as fill ports.

Alternatively, a stamping process may be employed wherein a "negative" of the desired foil pattern is created in a solid block of tool material by a machining process or by the etching process described above. The stamp is then used to forge the desired depressions and apertures in the individual foils. As a further alterative, electric discharge machining (EDM) technology may be employed wherein a negative of the desired foil pattern is again created in a solid block of material which is electrically conducive. The block serves as the cathode while the foil serves as the anode and as the block and foil are brought into contact, the high voltage between them serves to spall the metal from the anode (i.e. the foil) at the contact points. In this manner, the desired features are formed in the foil. Machining, laser cutting and electroforming are further alternative processes that may be utilized in fabricating a heat pipe device of the present invention.

While the diffusion bonding process is preferred because it does not require contact between disparate metals and can withstand very high operational temperatures, a soldering or a brazing process may be employed. Such processes require each foil to be coated with a thin coat of solder material or braze, etc. and the foil stack to be subjected to mild pressures and temperatures which melt the solder. In this manner, the foils are joined by the soldered joints. The resulting stack however is only as strong as the solder material and will become unbonded at temperatures above the solder's melting point.

After assembly, the bonded heat pipe structure is cleaned and evacuated through one of the fillports. An appropriate amount of coolant is subsequently introduced through such aperture and the aperture is sealed. Selection of the optimal amount of coolant is somewhat of an empirical process due to the many complex interrelationships involved. After sealing, the heat pipe is fully functional.

A number of different foil materials may be used in the construction of the heat pipe device of the present invention. Metallic foils on the order of 50 $\mu$m to 500 $\mu$m thick are preferred. Metals such as copper, aluminum and stainless steel are commonly employed in heat pipe construction and are particularly suited for the fabrication process described above.

Figure 7:
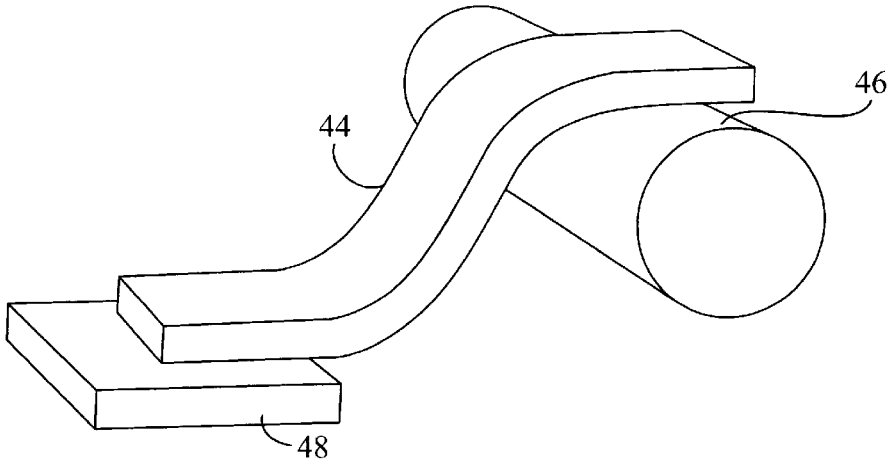
FIG. 7 is a perspective view of the heat pipe device of the present invention configured as a thermal strap.
Figure 8:
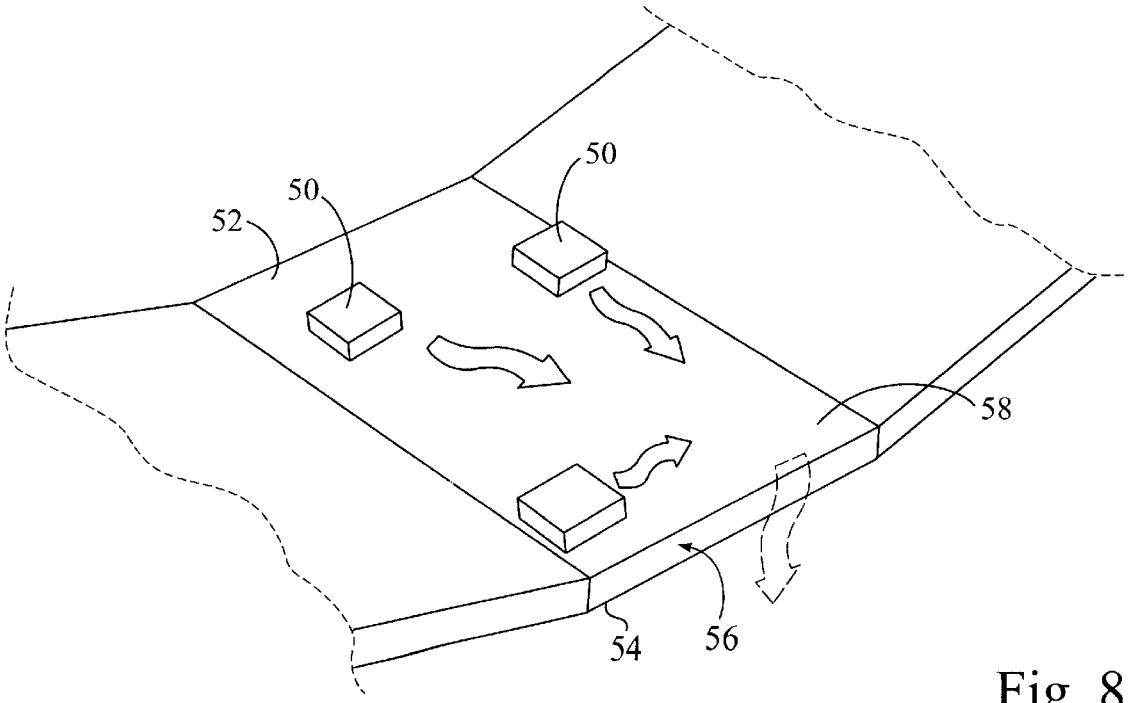
FIG. 8 illustrates an efficient flow of heat from multiple heat sources to a heat sink via a three-dimensional embodiment of the heat pipe of the present invention.

In operation, the heat source raises the temperature of that portion of the device adjacent thereto. Once the vaporization temperature is achieved, coolant begins to evaporate. The vapors diffuse through the network of cells and ports and condense when contact is made with the cold surface adjacent the heat sink. The condensate is drawn into the network of capillaries and is thereby able to return to areas of vaporization by capillary action. The process automatically proceeds in continuous fashion as long as the requisite high and low temperatures are maintained. In addition to simple single dimensional heat transfer configurations, the device according to the present invention is capable of transferring heat along a convoluted flowpath such as are shown in FIG. 5, and can advantageously be configured to tie multiple heat sources to multiple heat sinks as is shown in FIG. 6. FIG. 7 illustrates a "thermal strap" adaptation wherein the specially configured heat pipe device 44 of the present invention transfers heat from fluid flowing through a conduit 46 to an available heat sink 48 or vice versa. An additional advantage of the multi-dimensional heat transfer capability of the device of the present invention is illustrated in FIG. 8 wherein multiple heat sources are disposed on for example an interior wall of a spacecraft and efficiently transfer heat to its exterior which serves as a heat sink. The three-dimensional heat pipe device 56 of the present invention may be either contained within or actually form the wall or other structure component of the spacecraft. It is to be noted that due to conductive heating, the point directly across from each heat source will not typically be the coolest point and the device of the present invention allows heat to be shed most efficiently by automatically transferring heat to the coolest point 58. The heat transfer function is thereby automatically optimized.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A heat pipe device for transferring heat from a region of high temperature to a region of low temperature, comprising:

a lamination of a plurality of individual laminae wherein each lamina is formed with patterns of perforations therethrough and/or recesses thereon, and wherein such laminae are stacked on top of one another such that said patterns cooperate with patterns formed in adjacent laminae to define cells that extend through said lamination for vapor transport and to define capillary-like structures through said lamination for liquid transport;

faceplates joined to said lamination, wherein such faceplates are oriented in parallel to said laminae so as to be in fluid communication with said cells and said capillary-like structures and oriented so as to receive heat from said region of high temperature and to transfer heat to said region of low temperature; and coolant contained within said cells and capillary-like structures, selected to evaporate when subjected to the high temperature and condense when subjected to the low temperature.

2. The heat pipe device of claim 1, wherein said cells for vapor transport within said lamination extend in three dimensions.

3. The heat pipe device of claim 2, wherein said capillary-like structures for liquid transport extend in three dimensions within said lamination.

4. The heat pipe device of claim 1, wherein said capillary-like structures for liquid transport extend in three dimensions within said lamination.

5. The heat pipe device of claim 1, wherein said cells are in fluid communication with said capillary-like structures.

6. The heat pipe device of claim 5, wherein said faceplates have grooves formed therein so as to set said cells into fluid communication with said capillary-like structures.

7. The heat pipe device of claim 1, wherein said perforations in each individual laminae comprises hexagons arranged in a honeycomb pattern which cooperate with hexagonal patterns in adjacent laminae to form hexagonal cells within said lamination.

8. The heat pipe device of claim 7, wherein said hexagonal cells have ports formed therein so as to set adjacent cells into fluid communication with one another.

9. The heat pipe device of claim 1, wherein said perforations in said laminae have crenelated edges which cooperate with perforations having crenelated edges formed in adjacent laminae to define cells having grooved walls.

10. The heat pipe device of claim 9, wherein said laminae have recesses formed therein that define a network of said capillary-like structures extending across said laminae.

11. The heat pipe device of claim 9, wherein ducts are hexagonal and arranged in a honeycomb pattern.

12. The heat pipe device of claim 11, wherein said ducts are laterally spaced from one another so as to define said capillary-like structures therebetween.

13. The heat pipe device of claim 11, wherein said laminae have recesses formed therein that define said capillary-like structure surrounding each duct.

14. The heat pipe device of claim 13, wherein said ducts are spaced from one another so as to define said capillary-like structure therebetween.

15. The heat pipe device of claim 14, wherein said capillary-like structure defined between said ducts is in fluid communication with said capillary-like structure surrounding each duct.

16. The heat pipe device of claim 15, wherein said cells are in fluid communication with said capillary-like structures.

17. The heat pipe device of claim 16, wherein said faceplates have a grooved surface positioned so as to set said capillary-like structures into fluid communication with said cells.

* * * * *